US006928678B1

(12) United States Patent
Chang

(10) Patent No.: US 6,928,678 B1
(45) Date of Patent: Aug. 16, 2005

(54) TRANSPARENT APERTURED PILLOW, FILLED WITH FOAM BLOCKS

(76) Inventor: Heng-Tai Chang, No. 1, Alley 5, Lane 19, Taiping Rd., North District, Taichung City (TW)

( * ) Notice: Subject to any disclaimer, the term of this patent is extended or adjusted under 35 U.S.C. 154(b) by 0 days.

(21) Appl. No.: 10/778,353

(22) Filed: Feb. 17, 2004

(51) Int. Cl.[7] ..... A47G 9/00
(52) U.S. Cl. ..... 5/636; 5/641; 5/655.9
(58) Field of Search ..... 5/636, 641, 644, 5/655.9, 953, 637, 638, 639, 640, 643, 645, 646, 648

(56) References Cited

U.S. PATENT DOCUMENTS 2,298,218 A * 10/1942 Madson ..... 5/655.4
3,298,044 A * 1/1967 Saltness et al. ..... 5/644
3,563,837 A * 2/1971 Smith et al. ..... 428/71
4,109,332 A * 8/1978 Luck ..... 5/636
4,862,539 A * 9/1989 Bokich ..... 5/691
4,916,765 A * 4/1990 Castronovo, Jr. ..... 5/640
5,079,787 A * 1/1992 Pollmann ..... 5/655.4
5,299,335 A * 4/1994 Ivester et al. ..... 5/641
6,254,189 B1 * 7/2001 Closson ..... 297/397
6,367,105 B1 * 4/2002 Farley ..... 5/630
6,594,838 B1 * 7/2003 Hollander et al. ..... 5/636

FOREIGN PATENT DOCUMENTS

GB 977872 * 12/1964
WO WO 08/002384 A * 9/1981

* cited by examiner

*Primary Examiner*—Alexander Grosz
(74) *Attorney, Agent, or Firm*—Bacon & Thomas PLLC

(57) ABSTRACT

A pillow includes a transparent, apertured pillowcase having a receiving space inside and a plurality of deformable resilient blocks disposed inside the receiving space. Each of the resilient blocks is made of a foam material, such as latex.

4 Claims, 1 Drawing Sheet

TRANSPARENT APERTURED PILLOW, FILLED WITH FOAM BLOCKS

BACKGROUND OF THE INVENTION

1. Field of the Invention

The present invention relates generally to bedclothes, and more particularly to a pillow.

2. Description of the Related Art

People are becoming more aware of the importance of the quality of sleep, so they are more selective in choosing their bedding, especially pillows. Because pillows determine whether people sleep well or not, most people demand their pillows to be comfortable, air-permeable and, above all, to conform to their head shapes. However, everyone has an individual head shape that is more or less different from another, so it is not easy to select a pillow suitable for everyone.

Recently, many manufacturers in this field have developed related products, which provide comfort, air-permeability, and ergonomics. For example, pillows that are integrally formed of foam material, such as latex, are commonly called space pillows, ergonomic pillows, or memory pillows which conform to the human curvature from the neck to the head and are air-permeable and supportive to enable the user to feel comfortable.

The latex pillows are generally manufactured by injection molding with various moulds of different shapes and sizes to provide diversified shapes and sizes for children and adults. However, many different moulds are required to manufacture the pillows, so the production cost is relatively high.

Further, the conventional latex pillow has limited deformablity, so that the pillow does not completely conform to the user's head curve when the head of the user is placed on the pillow. Moreover, if the user turns back and forth on the bed while sleeping, the conventional latex pillow will not effectively deform to accommodate this motion.

In addition, the air-permeability of the material that the pillow is made deeply affects the quality of the pillow. If the material is not air-permeable, the user will easily feel tired and sleep badly. Hence, the user must pay much attention while selecting suitable pillows.

SUMMARY OF THE INVENTION

The primary objective of the present invention is to provide an improved pillow that has low production cost, is highly deformable to accommodate different head shapes, and prevents the user from feeling muggy and providing comfort during sleeping.

The foregoing objective of the present invention is attained by the improved pillow that includes a pillowcase having a receiving space inside and a plurality of resilient blocks disposed inside the receiving space. The resilient blocks are made of a foam material, such as latex.

DETAILED DESCRIPTION OF THE INVENTION

Figure 1:
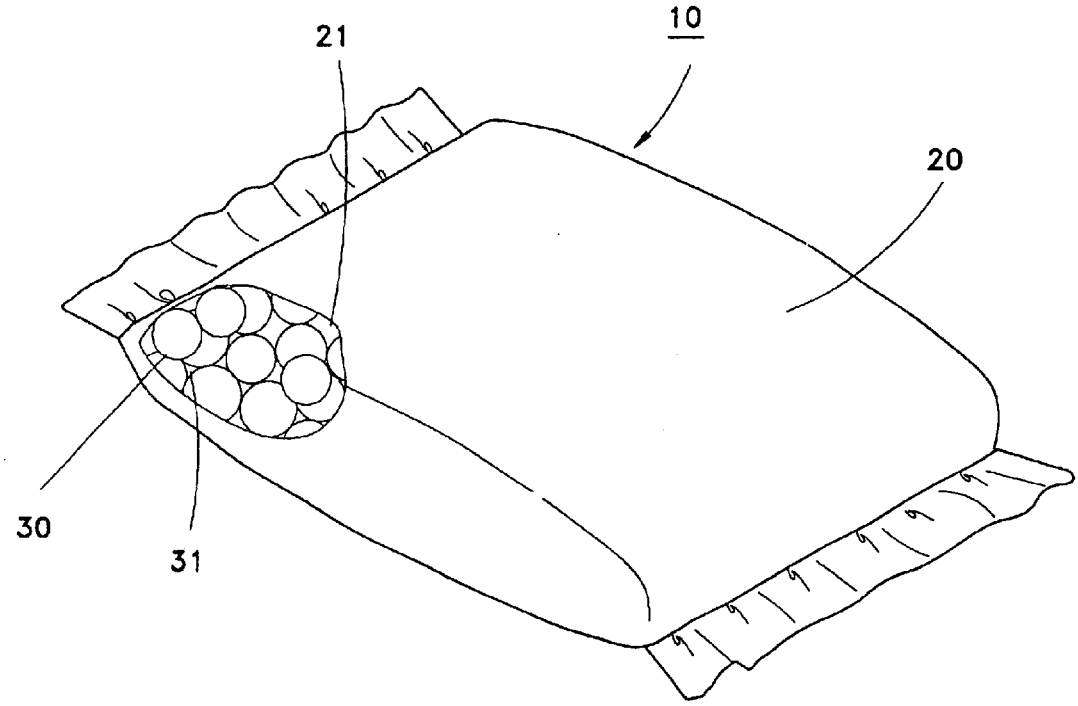
FIG. 1 is a perspective view of a first preferred embodiment of the present invention.

Referring to FIG. 1, a pillow 10 constructed according to a first preferred embodiment of the present invention includes a pillowcase 20 and a plurality of resilient blocks 30.

The pillowcase 20 is made of an air-permeable and ventilative cloth, and includes a receiving space 21 inside.

Each of the resilient blocks 30 is a small ball made of an injection molded foam material, such as latex, and is disposed inside the receiving space 21 and securely encapsulated by the pillowcase 20. The pillowcase 20 has a zipper to securely hold the resilient blocks 30 inside the pillowcase 20. Alternatively, the pillowcase 20 may have an opening to securely hold the resilient blocks 30 inside the pillowcase 20 by seaming the opening. Spacing 31 is formed between the resilient blocks 30.

When the head of the user is placed on the pillow 10, the resilient blocks 30 of the pillowcase 20 are squeezed and deformed and the spacing 31 is also deformed to further cause some of the resilient blocks 30 positioned under the head and the neck to slightly move towards bilateral sides of the pillowcase, such that the pillow 10 can conform to fit the head of the user. Further, when the user sleeps and turns back and forth to change the angle at which the head lies on the pillow 10, the pillow 10 is correspondingly deformed. In other words, the interrelated positions among the resilient blocks 30 change according to the user's sleeping motion and provide accommodating support for the user's head and neck, thereby further enabling the user to sleep more comfortably.

Further, the spacing 31 ventilates the air inside the receiving space 21 to reduce the temperature and humidity inside the pillow 10, such that the user feels quite comfortable while sleeping.

More, it is easy to reduce the production cost by the manufacturers producing a great number of the resilient blocks 30 and putting different numbers of the resilient blocks 30 into pillowcases 20 of different sizes to produce pillows of different sizes.

The resilient blocks 30 of the present invention are not limited in shape and appearance to provide resilient support.

Figure 2:
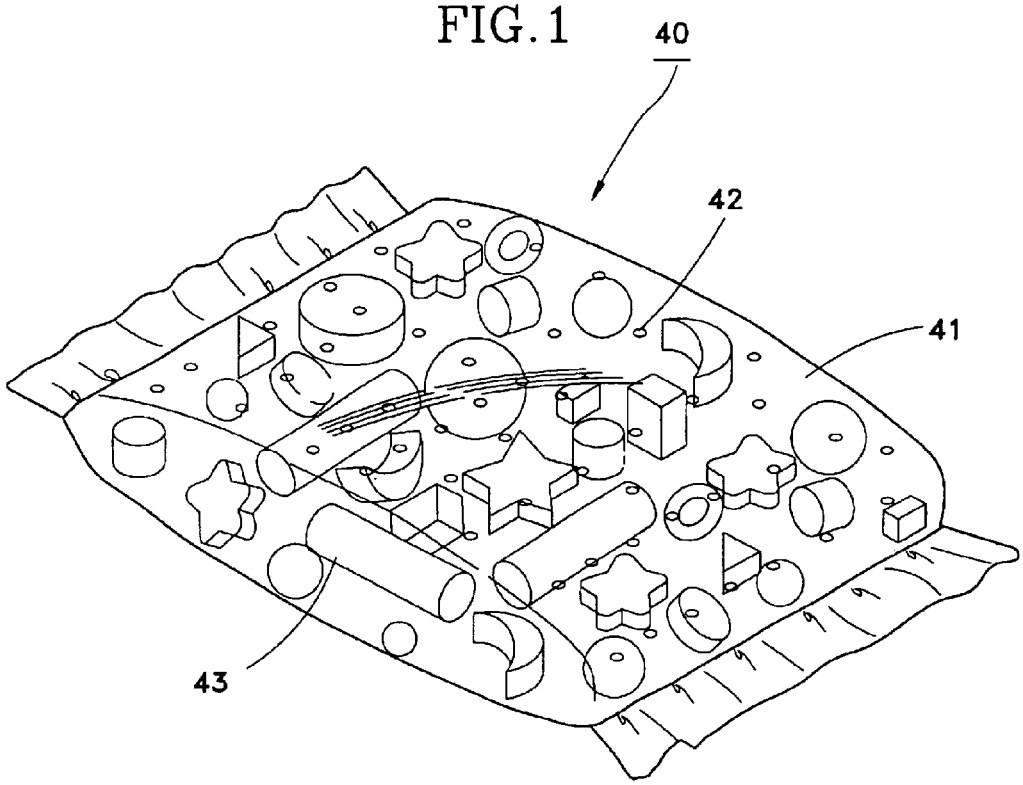
FIG. 2 is a perspective view of a second preferred embodiment of the present invention.

Referring to FIG. 2, the pillow 40 constructed according to a second preferred embodiment of the present invention is a pillow for children and is different from the first preferred embodiment in that the pillowcase 41 is made of a transparent plastic material having a plurality of apertures 42, and a plurality of resilient blocks 43 of various shapes and colors disposed inside the pillowcase 41. As best seen in FIG. 2, the apertures 42 are generally circular in shape, and are spaced apart from each other. The resilient blocks 43 can be, for example, rectangular, long-pillared, moon-shaped, or any shape attractive to children.

In addition, the resilient blocks used in the pillow of the present invention can also be soaked in diversified fragrant liquids that tranquilize the user and further help the user to sleep well.

What is claimed is:

1. A pillow comprising:

an air permeable pillowcase having an inside receiving space, the pillowcase being made of a transparent material and provided with a plurality of generally circular, spaced apart apertures formed therein;

a plurality of resilient blocks of different shapes formed of a deformable foam material, the blocks being disposed within the inside receiving space and defining a spacing therebetween; and whereby when the head of a user is placed on the pillow and subjected to movement, the pillow conforms to the changing position of the head through deformation of the resilient blocks and provides comfortable support for the user during sleep.

2. The pillow of claim 1, wherein the shape of each resilient block is selected from the group consisting of spherical, rectangular, columnar and rod-like.

3. The pillow of claim 1, wherein the resilient blocks are of different colors.

4. The pillow of claim 1, wherein the resilient blocks are provided with a fragrance.

* * * * *